US009697680B2

(12) United States Patent
Paradise et al.

(10) Patent No.: US 9,697,680 B2
(45) Date of Patent: Jul. 4, 2017

(54) COOPERATIVE GAMEPLAY IN PEER-TO-PEER WAGERING PLATFORM

(71) Applicant: Skillz Inc., Boston, MA (US)

(72) Inventors: Andrew Paradise, Boston, MA (US); Dennis Zografos, Somerville, MA (US)

(73) Assignee: Skillz Inc., San Francisco, CA (US)

( * ) Notice: Subject to any disclaimer, the term of this patent is extended or adjusted under 35 U.S.C. 154(b) by 0 days.

(21) Appl. No.: 14/467,559

(22) Filed: Aug. 25, 2014

(65) Prior Publication Data

US 2016/0055710 A1 Feb. 25, 2016

(51) Int. Cl.
*G07F 17/32* (2006.01)

(52) U.S. Cl.
CPC ..... *G07F 17/3225* (2013.01); *G07F 17/3244* (2013.01); *G07F 17/3274* (2013.01)

(58) Field of Classification Search
CPC ..... G07F 17/3274; G07F 17/3244; G07F 17/3225
USPC ..... 463/25
See application file for complete search history.

(56) References Cited

U.S. PATENT DOCUMENTS

| | | | | |
|---|---|---|---|---|
| 5,411,258 | A * | 5/1995 | Wilson et al. | 463/6 |
| 8,414,387 | B1 * | 4/2013 | Paradise | G07F 17/3225 463/25 |
| 2002/0160824 | A1 * | 10/2002 | Goto et al. | 463/9 |
| 2005/0043089 | A1 * | 2/2005 | Nguyen et al. | 463/29 |
| 2008/0207327 | A1 * | 8/2008 | Van Luchene et al. | 463/42 |
| 2009/0099924 | A1 * | 4/2009 | Lensch et al. | 705/14 |
| 2012/0122553 | A1 * | 5/2012 | Bunch et al. | 463/23 |

* cited by examiner

*Primary Examiner* — Michael Cuff
(74) *Attorney, Agent, or Firm* — Mintz Levin Cohn Ferris Glovsky and Popeo, P.C.

(57) ABSTRACT

Data can be received and can include a request to initiate a cooperative digital skills-based gaming competition and an identification of one or more additional players to invite to join a cooperative team. Data including an invitation to become members of the cooperative team can be transmitted using a transactional server and to clients associated with the additional players. An amount of funds for one or more of the members of the cooperative team to contribute to form a wager for the cooperative team can be determined. Data comprising a confirmation to initiate, which, when received by the game server, causes initiation of the cooperative digital skills-based gaming competition for the members of the cooperative team can be transmitted using the transactional server and to a game server. A prize can be caused to be distributed based on the outcome. Related apparatus, systems, techniques, and articles are also described.

20 Claims, 7 Drawing Sheets

COOPERATIVE GAMEPLAY IN PEER-TO-PEER WAGERING PLATFORM

TECHNICAL FIELD

The subject matter described herein relates to cooperative gameplay and wagering within electronic multiplayer games of skill using a peer-to-peer wagering platform.

BACKGROUND

An online game is a video game played over a network on some form of computer, mobile device, or on a video game console such as the Xbox 360 and PlayStation 3. This usually means the Internet or equivalent technology, but games can use a wide range of technologies. A recent expansion of online gaming has reflected the overall expansion of computer networks from small local networks to the Internet and the growth of Internet access itself.

Online games can range from simple text based games to mobile games to games incorporating complex graphics and virtual worlds populated by many players simultaneously. Many online games require skill and strategy and have a social aspect beyond single player games. For example, players compete head-to-head, in a tournament, or for the highest score on a leader board. Example categories of online skill-based games include first person shooters, real time strategy games, social games, role-playing games, board games, card games, etc. Due to their social nature, many online games are inherently competitive.

SUMMARY

In an aspect, data can be received at a transactional server. The data can include a request to initiate a cooperative digital skills-based gaming competition and an identification of one or more additional players to invite to join a cooperative team. The transactional server can include one or more data processors forming part of at least one computing system. Data including an invitation to become members of the cooperative team can be transmitted using the transactional server and to clients associated with the one or more additional players. Data including a confirmation to join the cooperative team can be received by the transactional server and from the clients associated with one or more additional players. An amount of funds for one or more of the members of the cooperative team to contribute to form a wager for the cooperative team can be determined. Data comprising a confirmation to initiate, which, when received by the game server, causes initiation of the cooperative digital skills-based gaming competition for the members of the cooperative team can be transmitted using the transactional server and to a game server. Data including an outcome of the cooperative digital skills-based gaming competition can be received from the game server. A prize can be caused to be distributed to one or more members of the cooperative team using the transactional server and based on the outcome.

In another aspect, data can be received at a team formation module operating on a transactional server. The data can include a request to initiate a cooperative digital skills-based gaming competition and an identification of one or more additional players to invite to join a cooperative team. The data can be received from a peer-wagering module integrated with a game instance executing on a client. The game instance can be of a digital game in which player skill is the dominate factor in determining game outcome. The transactional server can include one or more data processors forming part of at least one computing system. Data including an invitation to become members of the cooperative team can be transmitted using the team formation module operating on the transactional server and to clients associated with the one or more additional players. The invitation can be transmitted over one or more channels. Data including a confirmation to join the cooperative team can be received by the team formation module operating on the transactional server and from the clients associated with one or more additional players. An amount of funds for one or more of the members of the cooperative team to contribute to form a wager for the cooperative team can be determined using a wager module operating on the transactional server. Data including a confirmation to initiate, which, when received by the game server, causes initiation of the cooperative digital skills-based gaming competition for the members of the cooperative team can be transmitted using the transactional server and to a game server associated and in communication with game instances operating on each of the one or more additional player clients. Data including an outcome of the cooperative digital skills-based gaming competition can be received from the game server. A prize can be caused to be distributed to one or more members of the cooperative team using a distribution module operating on the transactional server. The prize can be based on the outcome.

One or more of the following features can be included in any feasible combination. For example, each member of the cooperative team can contribute an equal amount of funds to form the wager. The amount of funds to contribute can vary between at least two members of the cooperative team. Less than all members of the cooperative team can contribute funds to form the wager. An entity other than the members of the cooperative team can contribute to the wager when at least one of the one or more additional players registers an active account with the transactional server in response to the invitation to join the cooperative team. The data including the invitation can be transmitted using a plurality of channels. The plurality of channels can include two or more of: a social media network, email, SMS message, and a peer-to-peer wagering platform. The identification of the one or more additional players can identify specific players. The identification of the one or more additional players can identify a group of players.

The cooperative team can be matched to another cooperative team based on a metric of skill of the cooperative team. The prize can be distributed unequally among the members of the cooperative team. The prize can be distributed unequally among the members of the cooperative team according to a predefined distribution agreement between the members of the cooperative team. The prize can be distributed unequally among the members of the cooperative team based on a relative contribution of the members of the team to form the wager. The data including the outcome can include information characterizing whether one or more of the members of the cooperative team aborted play during the cooperative digital skills-based gaming competition. The prize may not be distributed to any member of the cooperative team who aborted play. A winning team can be determined based on the outcome in which one or more of the members of the cooperative team aborted play during the cooperative digital skills-based gaming competition.

Computer program products are also described that comprise non-transitory computer readable media storing instructions, which when executed by at least one data processor of one or more computing systems, causes at least one data processor to perform operations herein. Similarly, computer systems are also described that may include one or more data processors and a memory coupled to the one or more data processors. The memory may temporarily or permanently store instructions that cause at least one processor to perform one or more of the operations described herein. In addition, methods can be implemented by one or more data processors either within a single computing system or distributed among two or more computing systems.

The subject matter described herein provides many advantages. For example, the current subject matter can enable cooperative gameplay and wagering on asynchronous single-player games that otherwise do not allow cooperative team play. Individuals can be invited to use a peer-to-peer wagering platform to play cooperative games. Pre-existing contact information and social media may be leveraged to enable invitation of individuals not previously registered with the peer-to-peer wagering platform. Game outcomes can be determined when there are an uneven number of players on opposing teams. The current subject matter may increase daily active users of the peer-to-peer wagering platform by drawing new users into the system from external sources. Moreover, engagement in the peer-to-peer wagering platform and third party game can be increased through cooperative gameplay with friends.

The details of one or more variations of the subject matter described herein are set forth in the accompanying drawings and the description below. Other features and advantages of the subject matter described herein will be apparent from the description and drawings, and from the claims.

DESCRIPTION OF DRAWINGS

Like reference symbols in the various drawings indicate like elements.

DETAILED DESCRIPTION

The current subject matter enables cooperative gameplay and wagering within electronic multiplayer games of skill using a peer-to-peer wagering platform. Players can form cooperative teams, contribute entry fee funds (e.g., a team wager), and compete against other teams for prizes. Team members can contribute unequal amounts of funds to form a team wager and the peer-to-peer wagering platform can distribute the prize unequally to the team members.

Figure 1:
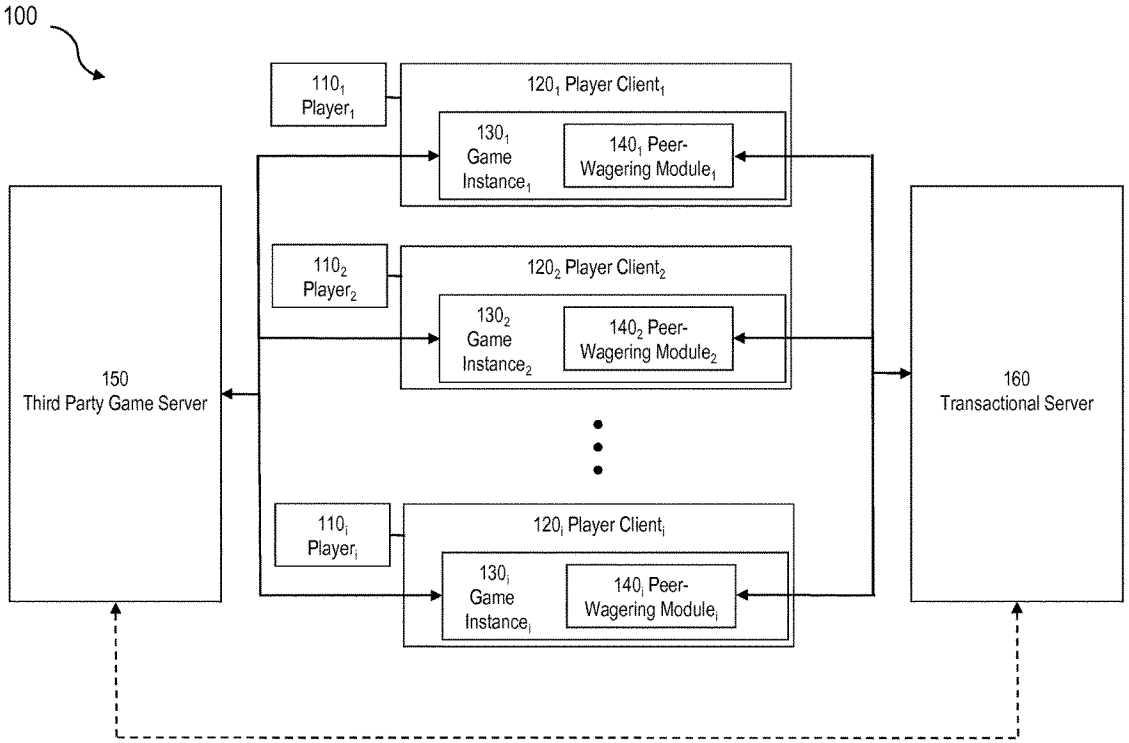
FIG. 1 is a system diagram illustrating a peer-to-peer wagering platform that facilitates cooperative gameplay wagering within electronic multiplayer games of skill.

FIG. 1 is a system diagram illustrating a peer-to-peer wagering platform 100 that facilitates cooperative gameplay wagering within electronic multiplayer games of skill. A plurality of players $\mathbf{110}_i$ (i=1, 2, . . . , N) can operate respective player clients $\mathbf{120}_i$. Each player client $\mathbf{120}_i$ can include a third party game instance $\mathbf{130}_i$. The game instance $\mathbf{130}_i$ can include any online digital game (e.g., video game) in which player skill is the dominate factor in determining game outcome, not chance. The multiple players $\mathbf{110}_i$ can compete against one another and/or can organize into cooperative teams. The cooperative teams can compete against one another online. Games can be consistent across game instances $\mathbf{130}_i$ (e.g., if the players $\mathbf{110}_i$ are playing chess, each game instance $\mathbf{130}_i$ is an instance of an electronic chess game). Each game instance $\mathbf{130}_i$ can be in communication with and receiving game data from a third party game server 150. The game server 150 can provide game data necessary to operate the game. Alternatively, game instances $\mathbf{130}_i$ can exchange game data directly.

Each game instance $\mathbf{130}_i$ can include a peer-wagering module $\mathbf{140}_i$. The peer-wagering module $\mathbf{140}_i$ can integrate into the game instance $\mathbf{130}_i$ and enables the players $\mathbf{110}_i$ to wager on the outcome of a given game competition. The peer-wagering module $\mathbf{140}_i$ communicates with and works in tandem with a transactional server 160. The transactional server 160 can maintain account information for each player $\mathbf{110}_i$, including financial information, and can act as a trusted party to hold funds in escrow and/or secure funds to enforce the terms of a wager (i.e., ensures winning players receive the winnings). The transactional server 160 can also pass data characterizing advertisements (e.g., advertising logic, invitations, and/or messages) to the third party game server 150.

Figure 2:
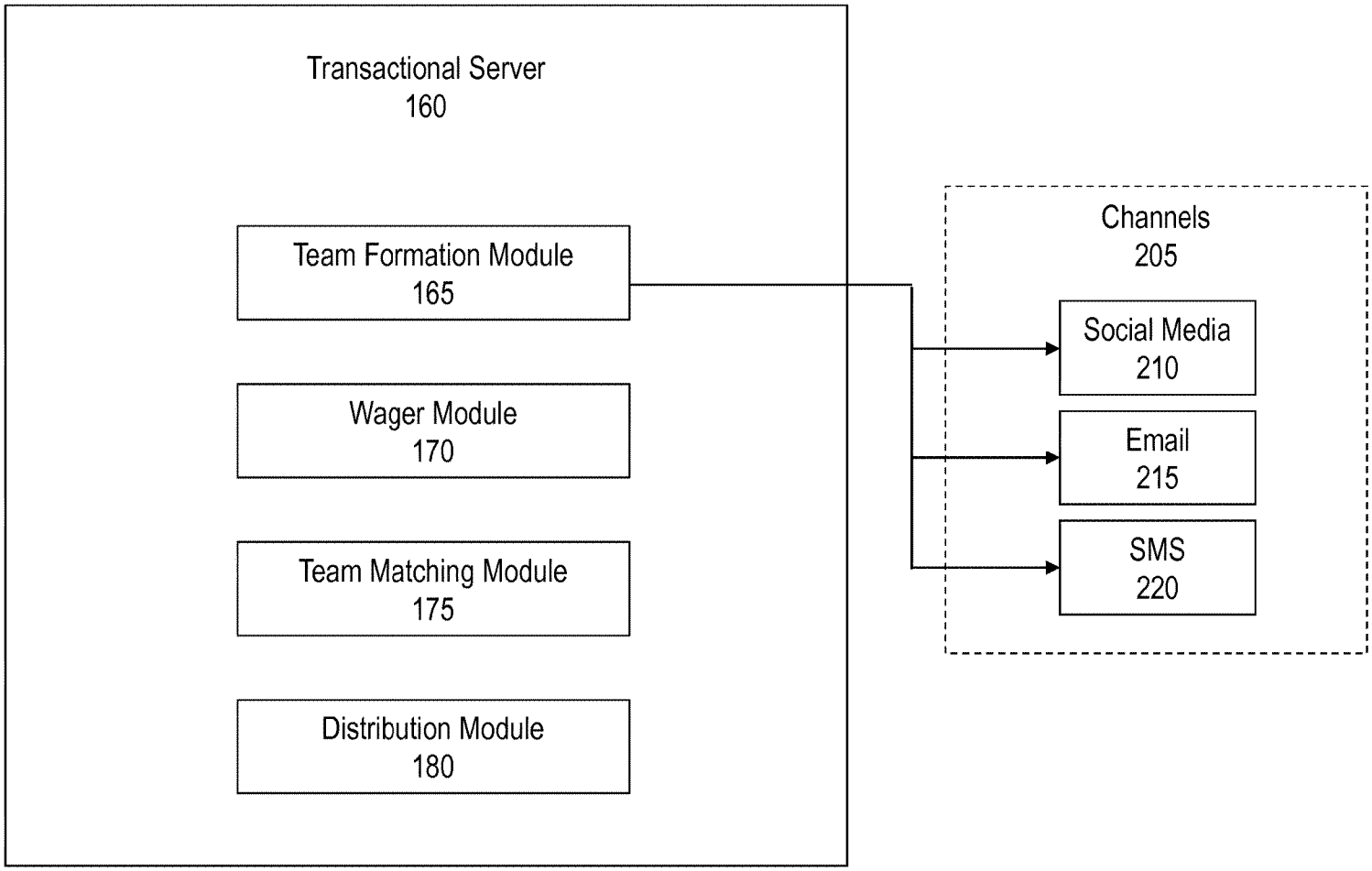
FIG. 2 is a block diagram of an example implementation of transactional server.

FIG. 2 is a block diagram of an example implementation of transactional server 160. The transactional server 160 can include a team formation module 165 that enables players $\mathbf{110}_i$ to organize into cooperative teams. For example, a player $\mathbf{110}_i$ can initiate cooperative wagering and game play by inviting one or more additional players $\mathbf{110}_i$ to enter into a cooperative game as members of a cooperative team. The team formation module 165 can receive a request to initiate a cooperative digital skills-based gaming competition from a player $\mathbf{110}_i$ (for example, via the client $\mathbf{120}_i$ and/or peer-wagering module $\mathbf{140}_i$). The team formation module 165 can also receive an identification of one or more additional players to invite to join a cooperative team. The identification of additional players can identify specific players (for example, by username, email, phone number, and the like) or the identification of additional players can identify a group of players to be invited (for example, players having a connection on a social network or to the public generally). A peer-wagering module $\mathbf{140}_i$ can generate and transmit the request and identification.

The team formation module 165 can generate and transmit an invitation to the identified additional players (for example, to their client $\mathbf{120}_i$ and/or peer-wagering module $\mathbf{130}_i$). The team formation module 165 can transmit the invitation through different channels 205. For example, if the player to-be-invited is a new player (e.g., the player does not have an existing account registered with the transactional server 160 and/or does not have a peer wagering module $\mathbf{140}_i$ installed on their client $\mathbf{130}_i$) the invite can be transmitted over one or more of social media network 210, email 215, short message service (SMS) message 220, and the like. In some implementations, when a new player is invited, they can participate in a first-time user experience that can include a tutorial and a practice (e.g., no stakes) game. If the player to-be-invited is a current player (e.g., the player has an existing account registered with the transactional server 160 and a peer-wagering module $\mathbf{140}_i$ installed on their client $\mathbf{130}_i$), the invitation can also be transmitted to the peer wagering module $\mathbf{140}_i$.

In order to aid a player $110_i$ in identifying additional players $110_i$ for invitation, connections can be established between the peer-to-peer wagering platform 100 and various forms of social connections (e.g., contacts lists on a phone, social media networks, and the like). The peer-to-peer wagering platform 100 can retrieve information about potential new players from these sources, communicate the retrieved information to the team formation module 165, and associate the retrieved information with a player's $110_i$ account. The player $110_i$ can invite any contacts associated with their account using the peer-wagering module $140_i$. Upon invitation, the invited player $110_i$ can be notified via one or more channels 205.

In some example implementations, players $110_i$ can invite additional players $110_i$ to be on their team, but do not invite players $110_i$ to be on an opposing team. Thus, members of a team can cooperate with one another and compete against another team.

The invited players $110_i$ can join the cooperative team and become team members, for example, by transmitting a confirmation to the transactional server 160. A cooperative team can create a competition or tournament (e.g., an initiation team) and other cooperative teams can join the competition or tournament (e.g., a joining team). Team members can contribute funds to form a wager or entry fee for the cooperative team to compete against at least one other team in a digital skills-based gaming competition. The winning team can receive a prize.

Team members can contribute varying amounts of funds to form the wager. For example, a player $110_i$ creating an invitation can specify the total wager and specify that they will contribute a portion of the total wager. In some implementations, the total wager amount is predefined and the invitation can request that the invited players $110_i$ contribute a predefined amount. For example, an invitation can include an indication that the inviting player $110_i$ will contribute $15 and the invited player $110_i$ should contribute $5 in order to join the team. In some example implementations, a first player $110_1$ can contribute the entire wager while a second player $110_2$ can join and/or participate on the team without contributing funds (e.g., a player can prepay the contribution for another player, for example, to encourage a friend to join their team) so that less than all members of the cooperative team contribute funds to form the wager. In some example implementations, team members can contribute equally to the wager (e.g., the total wager can be split evenly between all players on a team).

In some example implementations, an entity other than the players $110_i$ forming the cooperative team can contribute to the wager. For example, an operator of the peer-to-peer wagering platform can contribute to the wager of a team to promote the peer-to-peer wagering platform and/or cooperative gameplay features. The operator of the peer-to-peer wagering platform or another entity can contribute the entire wager when one or more of the team members registers an active account with the transactional server in response to the invitation to join the cooperative team (e.g., when one of the team mates is a "new" player). Other entities may contribute to the wager, for example, when one of the team members performs an action, as part of a rewards program, promotional campaign, and the like.

In some implementations, when each player $110_i$ joins a cooperative team, including contributing a wager (e.g., paying a team/competition entry fee), a wager module 170 in the transactional server 160 can determine an amount of funds for the player $110_i$ to contribute. The funds (e.g., contribution) can be secured (e.g., by the wager module 170 and/or transactional server 160). Secured funds cannot be withdrawn or used for another wager. Securing the funds can include transferring the funds from the player account to an escrow account as well as placing a "hold" on the funds in the player's account.

The transactional server 160 can include a team-matching module 175 for matching cooperative teams together for competition. Team matching module 175 can match teams based on a relative and/or composite skill level of the respective cooperative teams. For example, team-matching module 175 can use a dynamic average of each player's $110_i$ last one hundred games to determine an overall composite skill level. The matching can occur based on the best ranked (e.g., highest skilled) player from each cooperative team representing the team as a whole.

Invited players $110_i$ may also decline the invitation. In some implementations, when a player $110_i$ declines an invitation, transactional server 160 cancels the cooperative team and competition against another team does not occur. In this case, the players $110_i$ that have contributed to the team wager can have their contribution refunded. In some implementations, when a invited player $110_i$ on a joining team declines an invitation to compete, the competition proceeds and the player that declined can be accounted for when determining which cooperative team wins the competition in a manner that maintains fairness. When the invited player $110_i$ is a new player (e.g., does not have an active account registered with transaction server 160) and does not respond to the request in a predetermined amount of time, the transactional server 160 can consider the new player $110_i$ as having declined the invitation.

Once the transactional server 160 secures funds from all participating players $110_i$, the cooperative gameplay competition can proceed. The transactional server 160 can transmit a confirmation to initiate the game to the game server 150 to cause initiation of the cooperative digital skills-based gaming competition for the members of the cooperative team. The competition can proceed under normal game mechanics (such as each game instance $130_i$ communicating game data with the game server 150) until game play completes. In some implementations, the game server 150 conducts an individual play asynchronous game for each player $110_i$ (for example, each player on both sides of a cooperative team match can play individual games of an asynchronous game, such as a level of ANGRY BIRDS). The transactional server 160 can receive completed game statistics (including a numerical score) from the game server 150 or, alternatively, from each peer-wagering module $140_i$. The game statistics can indicate winners and losers based on one or more in-game metrics.

The transactional server 160 can determine cooperative team match outcome. A team score can be a composite score of the members of the team (e.g., a composite of their individual performance). In some implementations, the team score can comprise the sum of all team members' scores (e.g., a sum-vs-sum scoring scheme). The transactional server 160 can compare the team score of a first team (e.g., the sum of the first team member's individual scores) with a team score of a second team (e.g., the sum of the second team member's individual scores). The team with the best team score (e.g., highest, lowest, or other, depending on the game mechanics) can be determined to be the winner of the match. In other implementations, the transactional server 160 can compare the best individual team member score for each team (e.g., a best-vs-best scoring scheme). The cooperative team with the best individual score can be determined to be the winner of the match. Other schemes and methods for determining team wins are possible.

In some instances, a team member may not finish their game normally after game play initiates and the game server 150 does not report a score for that player. This can be considered an abort. An abort can occur intentionally, such as when a player $\mathbf{110}_i$ decides to forfeit the game, or unintentionally, such as when a client $\mathbf{120}_i$ malfunctions, loses battery charge, loses network connectivity, and the like. A player $\mathbf{110}_i$ may also attempt to cheat by turning off their client $\mathbf{120}_i$, disconnecting their internet access, forcing the game instance $\mathbf{120}_i$ to terminate, and the like. These cases can be considered as unintentional aborts to prevent players $\mathbf{110}_i$ from gaining an unfair advantage. In some implementations, players $\mathbf{110}_i$ who abort receive no prizes and are not refunded their wager contribution.

When a player $\mathbf{110}_i$ aborts during a cooperative team match, to ensure fairness a "stand-in player" can be defined. The stand-in player is not a player in the usual sense; no human person controls the stand-in player. Instead, the stand-in player's score is automatically calculated. Stand-in players can be automatically given the lowest scores reported by the opposite team. This effectively "cancels-out" the lowest scoring player or players on the opposite team, such that the better scoring players on each team are still engaged in fair competition. In a best-vs-best scoring scheme, a stand-in player score may not be needed because all team competition outcomes depend on the best score from an individual player.

Figure 3:
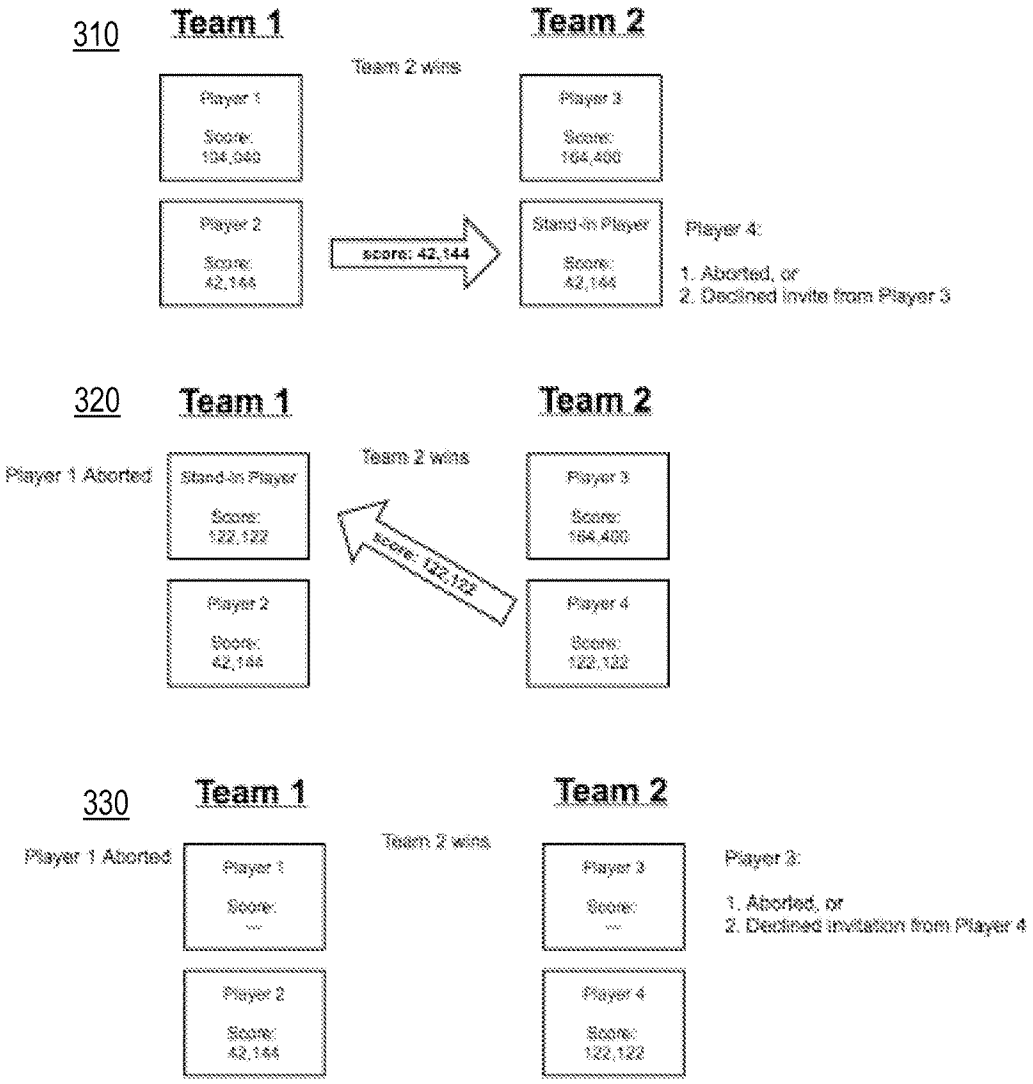
FIGS. 3-5 are block diagrams illustrating scenarios for handling player aborts and declines in a peer-to-peer wagering platform.
Figure 4:
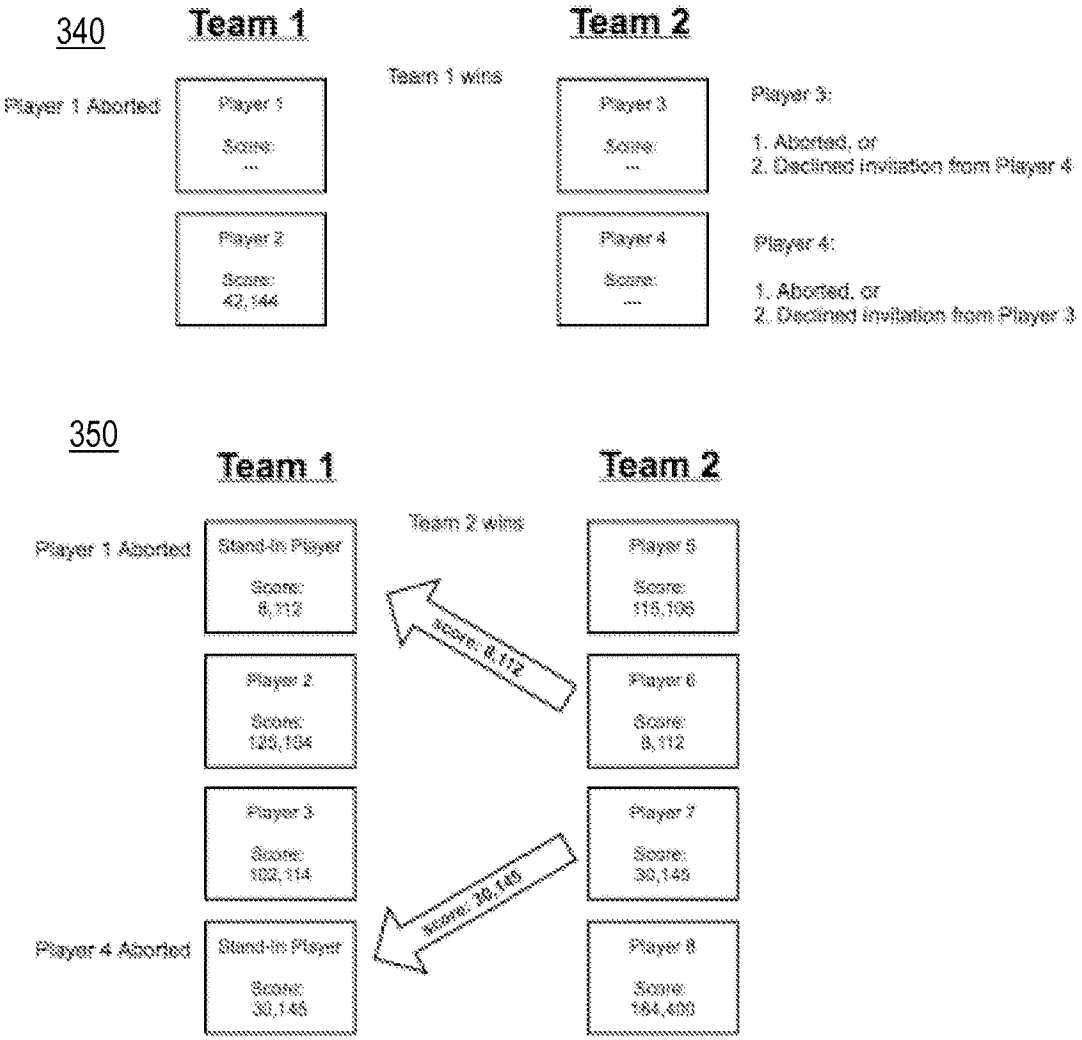
Figure 5:
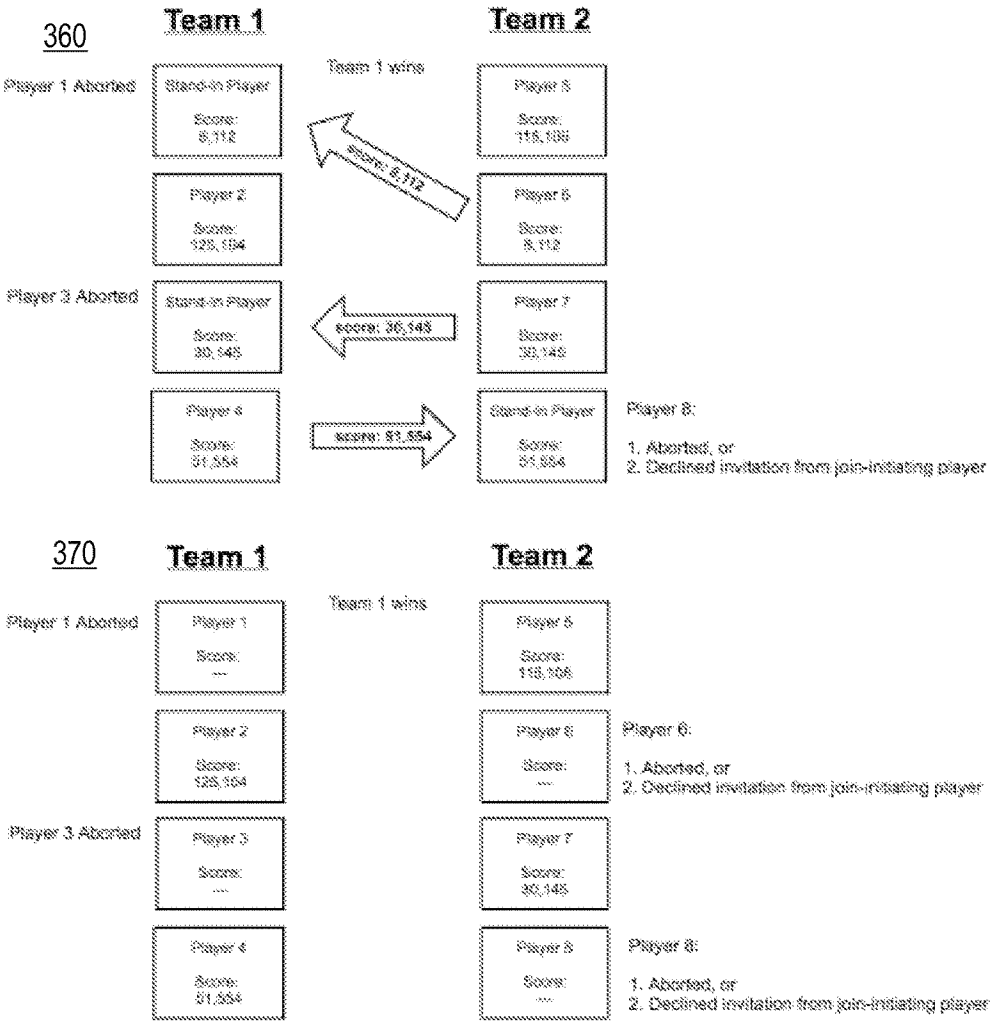

In a sum-vs-sum scoring scheme, the worst, second worst, and so forth score can be copied from the team opposite to the aborted player $\mathbf{110}_i$ to cancel-out the aborted player $\mathbf{110}_i$, leaving only the top score(s) to be used in determining the winning team. FIGS. 3-5 are block diagrams illustrating scenarios for handling player aborts and declines in a peer-to-peer wagering platform 100. At 310, team 1 is comprised of player 1 and player 2, while team 2 is comprised of player 3 and player 4. In the example scenario illustrated at 310, player 4 either aborts during gameplay or declines an invitation from player 3 to form a cooperative team. In either case, the low score from team 1, in this case player 2's score, is used as a stand-in score for team 2. Team 2 will win the competition because the sum of scores of team 2 (when considering the stand-in score) is greater than the sum of scores of team 1.

In the scenario illustrated at 320, a team member from team 1 (i.e., player 1) aborts during gameplay. In this instance, the low score from team 2, which is player 4's score, is used as the stand-in score. Team 2 will win the competition because the sum of score of team 2 is greater than the sum of score of team 1 (when considering team 1's stand-in score). In the scenario illustrated at 330, a team member from each of team 1 and team 2 (i.e., player 1 and 3, respectively) aborts during gameplay or, in some implementations, declined an invitation to join. In this instance, no stand-in player/score is required because each team has an equal number of participating players.

In the scenario illustrated at 340, all members of a team (i.e., team 2) abort during gameplay and/or decline the invitation. In this instance, team 2 forfeits the competition. In the scenario illustrated at 350, in which each team has four players, multiple players on team 1 (i.e., player 1 and player 4) abort during gameplay. In this instance, the lowest two scores serve as stand-in scores for team 1. In the scenario illustrated at 360, multiple players on team 1 (i.e., players 1 and 3) abort during gameplay, while one player on team 2 (i.e., player 8) aborts during gameplay or declines an invitation. Two stand-in scores are used for team 1 and one stand-in score is used for team 2. Team 1 wins the competition because the sum of their scores, including the stand-in scores for players 1 and 3, is greater than the sum of scores, including the stand-in score for player 8, for team 2. In the scenario illustrated at 370, two players from each of team 1 and team 2 (i.e., players 1 and 3; and 6 and 8, respectively) abort or decline an invitation to join the cooperative team. No stand-in score is required because each team has an equal number of participating players.

Referring again to FIG. 2, the transactional server 160 can include a distribution module 180 for causing distribution of prize funds to members of the winning cooperative team. The distribution module 180 can distribute the prize equally among team members or unequally. The distribution module 180 can distribute the prize according to a pre-defined distribution agreement between the team members. A pre-defined distribution agreement can include an agreement for a distribution relative to the contribution of each team member to the team wager. For example, if a first team member contributes 75% of the total team wager and a second team member contributes 25% of the total team wager, then the distribution module 180 can distribute 75% of the prize to the first team member and 25% to the second team member. Team members can agree to distributions that are not relative to contribution amounts. For example, a first and second team member can each contribute equally (e.g., 50% each) to the team wager but the prize can be distributed 75% to the first team member and 25% to the second team member. In some implementations, distribution module can distribute the prize according to relative game performance. For example, if the first team member scores 4 points while the second team member scores 6 points, distribution module 180 can distribute 40% of the prize to the first team member and 60% of the prize can be distributed to the second team member. Other distribution schemes are possible. Distribution schemes can be agreed upon during team formation and can be included in the invitation.

In some implementations, distribution module 180 distributes no prize to a player $\mathbf{110}_i$ who aborts the game, regardless of whether the abort was intentional or unintentional. In some implementations, an operator of the game server 150 provides a refund to the aborted player $\mathbf{110}_i$.

The transactional server 160 can cause the prize to be distributed to the winning team members. In some implementations, the transactional server 160 can transfer the previously secured funds to one or more player $\mathbf{110}_i$ accounts based on the game statistics. For example, a winning player can have the player's winnings transferred from the other players' accounts or the secure escrow account into the winning player's account. In some implementations, the transactional server 160 can send an instruction to an outside financial service account to credit an account associated with a winning player $\mathbf{110}_i$. The transactional server 160 can send financial data related to winnings and losses to each peer-wagering module $\mathbf{140}_i$, which provides the financial data to the players $\mathbf{110}_i$. Additionally, the transactional server 160 can send the game statistics to each peer-wagering module $\mathbf{140}_i$, which provides the game statistics to the player $\mathbf{110}_i$.

Players $\mathbf{110}_i$ can register accounts, as well as fund and withdraw from the accounts either directly with the transactional server 160 (for example, accessing the transactional server 160 via a web browser) or through the peer-wagering module $\mathbf{140}_i$. The players $\mathbf{110}_i$ can fund their account through several means, such as, for example: PayPal, credit cards, Automated Clearing House (ACH) transfer, cash, loyalty cards, pre-paid cards, coupons, system credit, credit earned by watching advertisements, Google checkout, etc. Other methods of funding the account are possible.

The peer-wagering module 140$_i$ can provide necessary user interface components and player 110$_i$ to transactional server 160 interaction functionality for the game instance 130$_i$. This can provide a low barrier for third party game providers to enable the peer-wagering functionality into the game. The peer-wagering module 140$_i$ can be implemented with platform specific software development kits (SDKs).

Communication can occur over any suitable communications network, such as, for example, the internet.

Figure 6:
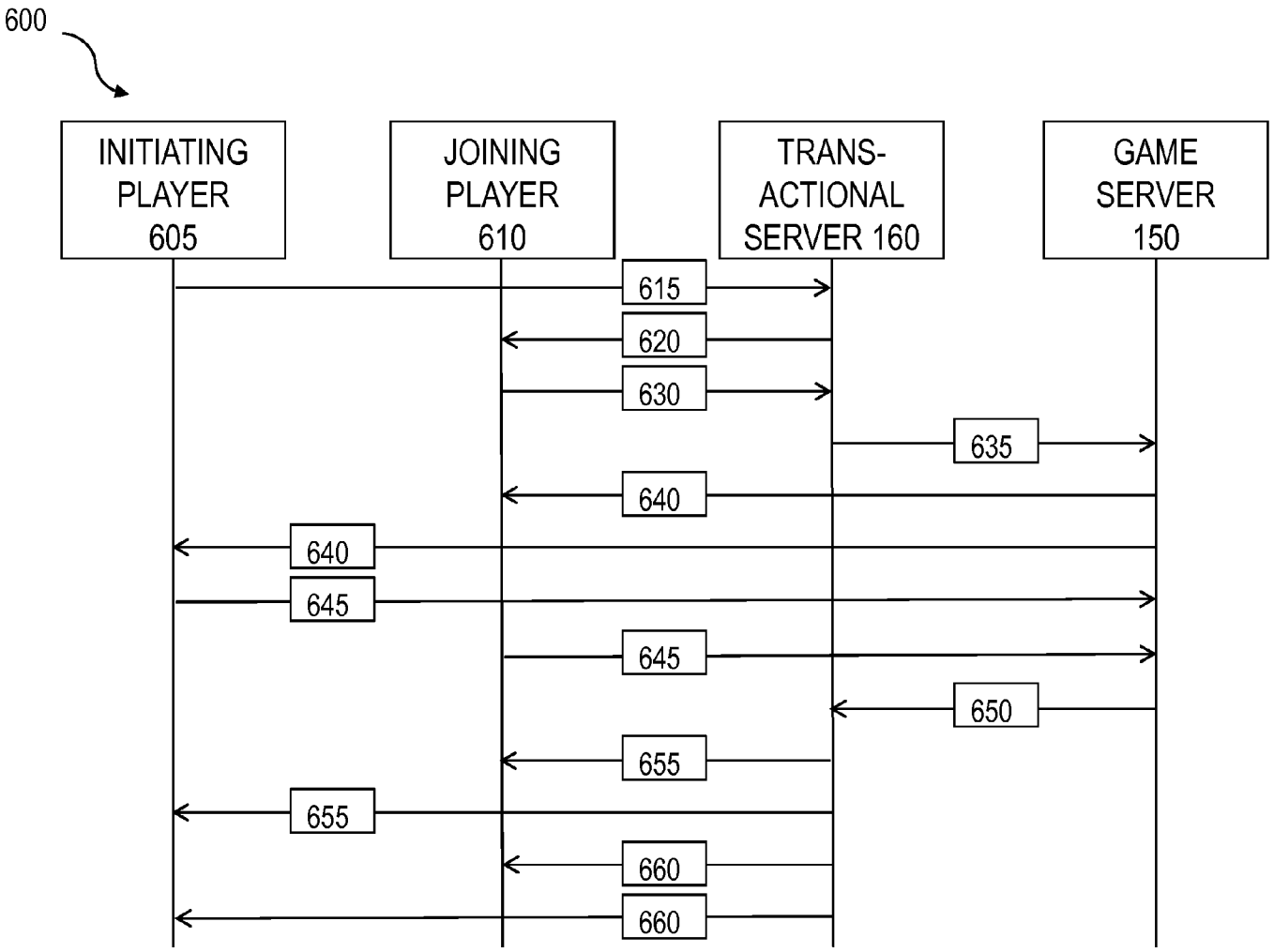
FIG. 6 is a signal flow diagram illustrating data flow and timing for players to form a cooperative team, wager on, and compete in a cooperative digital skills-based gaming competition.

FIG. 6 is a signal flow diagram 600 illustrating data flow and timing for players to form a cooperative team, wager on, and compete in a cooperative digital skills-based gaming competition. An initiating player 605 can transmit, at 615 and to transactional server 160, a request to initiate a cooperative digital skills-based gaming competition and an identification of a joining player 610. The transactional server 160 can receive the request, and the transactional server 160 can generate and transmit, at 620, an invitation to become a member in the cooperative team to the joining player 610. The transactional server 160 can transmit the invitation over one or more different channels. Joining player 610 can receive the invitation and generate and transmit, at 630, a confirmation to join the cooperative team to the transactional server 160. The transactional server 160 can receive the confirmation from the joining player 610 and can determine and secure an amount of funds for one or more members of the cooperative team to contribute to form a wager for the cooperative team. The transactional server 160 can match the cooperative team to another cooperative team (e.g., formed using a similar data flow for different players) for competition. The transactional server 160 can transmit, at 635, a confirmation to initiate a competition to the game server 150.

Normal gameplay can proceed with game information transmitted at 640 and 645 between the gameplay server 150 and the initiating player 605 and joining player 610. Once gameplay has complete, the game server 150 can transmit, at 650, an outcome of the gameplay for each player from to the transactional server 160. The transactional server 160 can determine, using the outcome of the gameplay for each player, the outcome of the cooperative competition. Based on the outcome of the cooperative competition, the transactional server can transmit a notification of game outcome to each player on the cooperative team (e.g., initiating player 605 and joining player 610). The transactional server 160 can determine an amount of funds for each player on the wining cooperative team to receive as a prize and can cause the prizes to be distributed. In some implementations, the transactional server 160 can, at 660, distribute the prize directly to the initiating player 605 and joining player 610.

Figure 7:
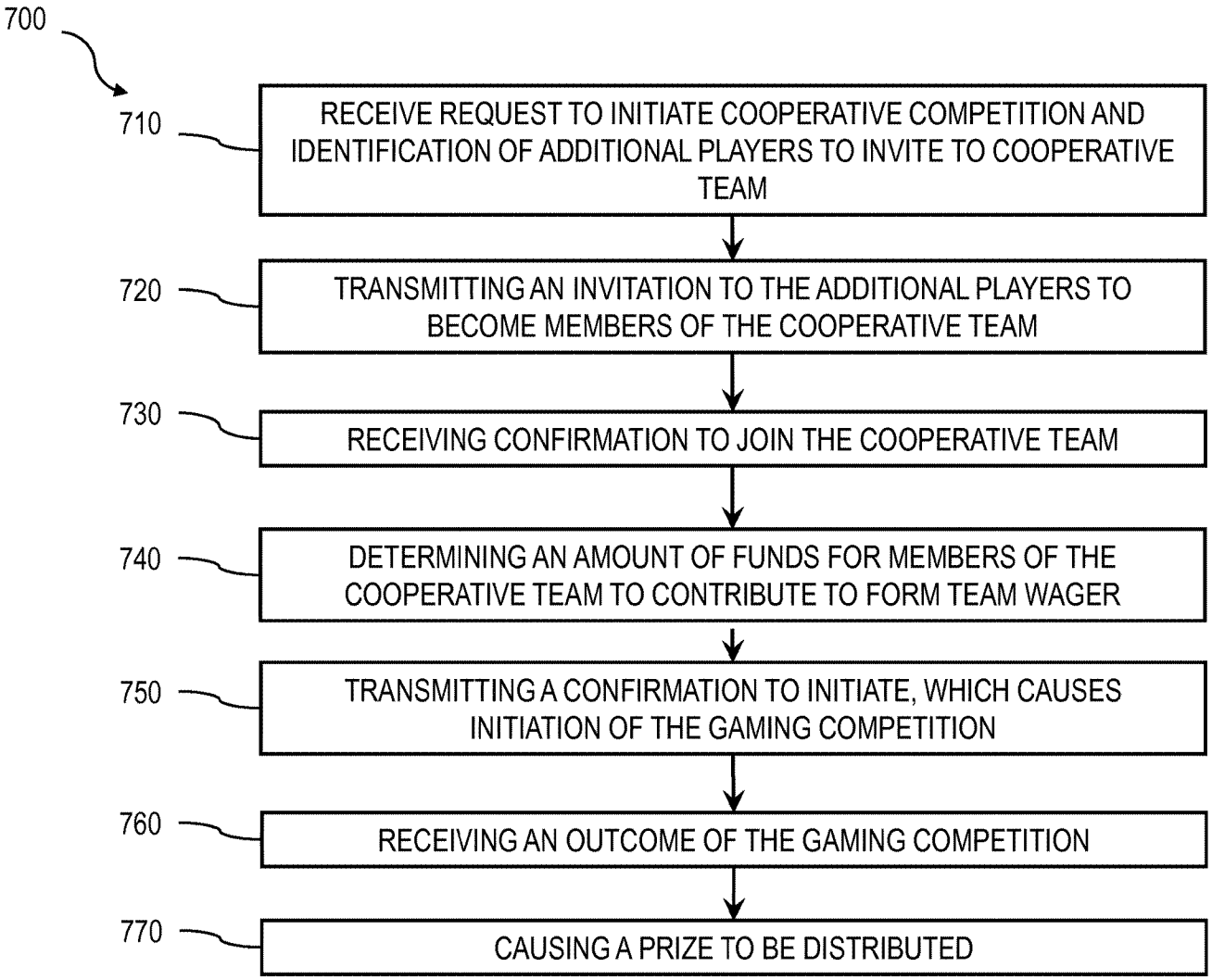
FIG. 7 is a process flow diagram illustrating a method of providing for cooperative wagering in a cooperative digital skills-based gaming competition.

FIG. 7 is a process flow diagram illustrating a method 700 of providing for cooperative wagering in a cooperative digital skills-based gaming competition. A request to initiate a cooperative competition and identification of additional players to invite to the cooperative team can be received at 710. An invitation to the additional players to become members of the cooperative team can be transmitted at 720. A confirmation to join the cooperative team can be received at 730. An amount of funds for members of the cooperative team to contribute to form a team wager can be determined and/or secured at 740. A confirmation to initiate the cooperative gaming competition can be transmitted at 750, which, when received, causes the initiation of the gaming competition. An outcome of the gaming competition can be received at 760, and a prize can be caused to be distributed at 770.

Various implementations of the subject matter described herein may be realized in digital electronic circuitry, integrated circuitry, specially designed ASICs (application specific integrated circuits), computer hardware, firmware, software, and/or combinations thereof. These various implementations may include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and may be implemented in a high-level procedural and/or object-oriented programming language, and/or in assembly/machine language. As used herein, the term "machine-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the subject matter described herein may be implemented on a computer having a display device (e.g., a CRT (cathode ray tube) or LCD (liquid crystal display) monitor) for displaying information to the user and a keyboard and a pointing device (e.g., a mouse or a trackball) by which the user may provide input to the computer. Other kinds of devices may be used to provide for interaction with a user as well; for example, feedback provided to the user may be any form of sensory feedback (e.g., visual feedback, auditory feedback, or tactile feedback); and input from the user may be received in any form, including acoustic, speech, or tactile input.

The subject matter described herein may be implemented in a computing system that includes a back-end component (e.g., as a data server), or that includes a middleware component (e.g., an application server), or that includes a front-end component (e.g., a client computer having a graphical user interface or a Web browser through which a user may interact with an implementation of the subject matter described herein), or any combination of such back-end, middleware, or front-end components. The components of the system may be interconnected by any form or medium of digital data communication (e.g., a communication network). Examples of communication networks include a local area network ("LAN"), a wide area network ("WAN"), and the Internet.

The computing system may include clients and servers. A client and server are generally remote from each other and typically interact through a communication network. The relationship of client and server arises by virtue of computer programs running on the respective computers and having a client-server relationship to each other.

Although a few variations have been described in detail above, other modifications are possible. For example, the implementations described above can be directed to various combinations and subcombinations of the disclosed features and/or combinations and subcombinations of several further features disclosed above. In addition, the logic flows depicted in the accompanying figures and described herein do not require the particular order shown, or sequential order, to achieve desirable results. Other embodiments may be within the scope of the following claims.

What is claimed is:

1. A method comprising:

receiving, at a transactional server and from a peer wagering module, data comprising a request to initiate a cooperative digital skills-based gaming competition and an identification of one or more additional players to invite to join a cooperative team, the transactional server comprising one or more data processors forming part of at least one computing system, the peer wagering module integrated into a third party game instance operating on a client, the peer wagering module communicating with and working with the transactional server;

transmitting, using the transactional server and to clients associated with the one or more additional players, data comprising an invitation to become members of the cooperative team;

receiving, by the transactional server and from the clients associated with one or more additional players, data comprising a confirmation to join the cooperative team;

determining, using the transactional server, an amount of funds for one or more of the members of the cooperative team to contribute to form a wager for the cooperative team;

transmitting, using the transactional server and to a game server, data comprising a confirmation to initiate, which, when received by the game server, causes initiation of the cooperative digital skills-based gaming competition and contemporaneous game play for the members of the cooperative team, the cooperative digital skills-based gaming competition provided to each member contemporaneously by a respective peer wagering module integrated into a respective game instance operating on a respective client such that games are played contemporaneously;

receiving, from the game server, data comprising an outcome of the cooperative digital skills-based gaming competition; and causing to be distributed a prize to one or more members of the cooperative team using the transactional server and based on the outcome.

2. The method of claim 1, wherein each member of the cooperative team contributes an equal amount of funds to form the wager.

3. The method of claim 1, wherein the amount of funds to contribute varies between at least two members of the cooperative team.

4. The method of claim 1, wherein fewer than all members of the cooperative team contribute funds to form the wager.

5. The method of claim 1, wherein an entity other than the members of the cooperative team contribute to the wager when at least one of the one or more additional players registers an active account with the transactional server in response to the invitation to join the cooperative team.

6. The method of claim 1, wherein the data comprising the invitation is transmitted using a plurality of channels, the plurality of channels comprising two or more of: a social media network, email, SMS message, and a peer-to-peer wagering platform.

7. The method of claim 1, wherein the identification of the one or more additional players identifies specific players.

8. The method of claim 1, wherein the identification of the one or more additional players identifies a group of players.

9. The method of claim 1, further comprising:

matching the cooperative team to another cooperative team based on a metric of skill of the cooperative team.

10. The method of claim 1, wherein the prize is distributed unequally among the members of the cooperative team.

11. The method of claim 1, wherein the prize is distributed unequally among the members of the cooperative team according to a predefined distribution agreement between the members of the cooperative team, the predefined distribution agreement included in the invitation to become members of the cooperative team transmitted to the clients associated with the one or more additional players.

12. The method of claim 1, wherein the prize is distributed unequally among the members of the cooperative team based on a relative contribution of the members of the team to form the wager.

13. The method of claim 1, wherein the data comprising the outcome includes information characterizing whether one or more of the members of the cooperative team aborted play during the cooperative digital skills-based gaming competition, and wherein the prize is not distributed to any member of the cooperative team who aborted play.

14. The method of claim 1, further comprising determining a winning team based on the outcome, wherein one or more of the members of the cooperative team aborted play during the cooperative digital skills-based gaming competition.

15. A method comprising:

receiving, at a team formation module operating on a transactional server, data comprising a request to initiate a cooperative digital skills-based gaming competition and an identification of one or more additional players to invite to join a cooperative team, the data received from a peer-wagering module integrated with a game instance executing on a client, the game instance of a digital game in which player skill is the dominant factor in determining game outcome, the transactional server comprising one or more data processors forming part of at least one computing system, the peer wagering module communicating with and working with the transactional server;

transmitting, using the team formation module operating on the transactional server and to clients associated with the one or more additional players, data comprising an invitation to become members of the cooperative team, the invitation transmitted over one or more channels;

receiving, by the team formation module operating on the transactional server and from the clients associated with one or more additional players, data comprising a confirmation to join the cooperative team;

determining, using a wager module operating on the transactional server, an amount of funds for one or more of the members of the cooperative team to contribute to form a wager for the cooperative team;

transmitting, using the transactional server and to a game server associated and in communication with game instances operating on each of the one or more additional player clients, data comprising a confirmation to initiate, which, when received by the game server, causes initiation of the cooperative digital skills-based gaming competition and contemporaneous game play for the members of the cooperative team, the cooperative digital skills-based gaming competition provided to each member contemporaneously by a respective peer wagering module integrated into a respective game instance operating on a respective client such that games are played contemporaneously;

receiving, from the game server, data comprising an outcome of the cooperative digital skills-based gaming competition; and causing to be distributed a prize to one or more members of the cooperative team using a distribution module operating on the transactional server, the prize based on the outcome.

16. A system comprising at least one data processor and memory storing instructions which, when executed by the at least one data processor, causes the at least one data processor to perform operations comprising:

receiving, at a transactional server and from a peer wagering module, data comprising a request to initiate a cooperative digital skills-based gaming competition and an identification of one or more additional players to invite to join a cooperative team, the transactional server comprising one or more data processors forming part of at least one computing system, the peer wagering module integrated into a third party game instance operating on a client, the peer wagering module communicating with and working with the transactional server;

transmitting, using the transactional server and to clients associated with the one or more additional players, data comprising an invitation to become members of the cooperative team;

receiving, by the transactional server and from the clients associated with one or more additional players, data comprising a confirmation to join the cooperative team;

determining, using the transactional server, an amount of funds for one or more of the members of the cooperative team to contribute to form a wager for the cooperative team;

transmitting, using the transactional server and to a game server, data comprising a confirmation to initiate, which, when received by the game server, causes initiation of the cooperative digital skills-based gaming competition and contemporaneous game play for the members of the cooperative team, the cooperative digital skills-based gaming competition provided to each member contemporaneously by a respective peer wagering module integrated into a respective game instance operating on a respective client such that games are played contemporaneously;

receiving, from the game server, data comprising an outcome of the cooperative digital skills-based gaming competition; and causing to be distributed a prize to one or more members of the cooperative team using the transactional server and based on the outcome.

17. The system of claim 16, wherein each member of the cooperative team contributes an equal amount of funds to form the wager.

18. The system of claim 16, wherein the amount of funds to contribute varies between at least two members of the cooperative team.

19. The system of claim 16, wherein fewer than all members of the cooperative team contribute funds to form the wager.

20. The system of claim 16, wherein an entity other than the members of the cooperative team contribute to the wager when at least one of the one or more additional players registers an active account with the transactional server in response to the invitation to join the cooperative team.

* * * * *